US007398767B2

(12) United States Patent
Kondo et al.

(10) Patent No.: US 7,398,767 B2
(45) Date of Patent: Jul. 15, 2008

(54) FUEL INJECTION DEVICE

(75) Inventors: Tetsuji Kondo, Tokyo (JP); Mikihiko Suzuki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 646 days.

(21) Appl. No.: 10/808,292

(22) Filed: Mar. 25, 2004

(65) Prior Publication Data

US 2004/0237939 A1 Dec. 2, 2004

(30) Foreign Application Priority Data

May 28, 2003 (JP) ..... 2003-150610

(51) Int. Cl.
*F02M 61/14* (2006.01)
*F02M 61/16* (2006.01)

(52) U.S. Cl. ..... 123/470; 123/468

(58) Field of Classification Search ..... 123/470, 123/468, 469, 456, 472; 239/550, 551, 600, 239/533.2

See application file for complete search history.

(56) References Cited

U.S. PATENT DOCUMENTS 5,024,198 A * 6/1991 Usui ..... 123/468
5,038,738 A * 8/1991 Hafner et al. ..... 123/470
5,167,213 A * 12/1992 Bassler et al. ..... 123/470
5,209,204 A * 5/1993 Bodenhausen et al. ..... 123/470
5,724,946 A * 3/1998 Franchitto ..... 123/470
6,016,831 A 1/2000 Bueser et al.

FOREIGN PATENT DOCUMENTS

| | | | |
|---|---|---|---|
| JP | 56-12051 | A | 2/1981 |
| JP | 03-31572 | A | 2/1991 |
| JP | 2000-509463 | A | 7/2000 |
| JP | 2000-512361 | A | 9/2000 |
| JP | 2001-90888 | A | 4/2001 |
| JP | 2002-070690 | | 3/2002 |
| JP | 2002-535550 | A | 10/2002 |
| WO | WO 98/44257 | A1 | 10/1998 |

* cited by examiner

*Primary Examiner*—Mahmoud Gimie
(74) *Attorney, Agent, or Firm*—Sughrue Mion, PLLC

(57) ABSTRACT

Any specific member for fixation is omitted from a fuel injection device so that number of parts is reduced and the fuel injection device is constructed at a reasonable cost. The fuel injection device for use in an internal combustion engine is provided with a fuel distribution pipe 1, plural connecting pipe members 4, and plural fuel injection valves 2, and each of the fuel injection valves 2 is inserted into a connecting pipe member 4. A band-shaped protrusion 7 extends in the radial direction from a flange portion of the connecting pipe member 4 and further extends in parallel to the axis of the fuel injection valve 2. The band-shaped protrusion 7 is provided with a fitting hole 8, and each fuel injection valve 2 is provided with a protrusion 9 fitted into the fitting hole 8.

5 Claims, 18 Drawing Sheets

FUEL INJECTION DEVICE

BACKGROUND OF THE INVENTION

1. Field of the Invention

The present invention relates to a fuel injection device used in an internal combustion engine and, more particularly, to mounting structure for mounting a fuel injection valve on a fuel distribution pipe.

2. Description of the Related Art

As an example of conventional structure for mounting a fuel injection valve on a fuel distribution pipe, a fixing member that partially holds a connecting pipe member and the fuel injection valve and has a configuration corresponding to the fuel injection valve couples each of fuel injection valves with a fuel distributor without applying any force in the axial direction so as to fix the fuel injection valve in the axial direction (for example, see the Japanese Patent Publication (unexamined) No. 1981-12051 (FIGS. 1 and 2)).

As another example of conventional structure for mounting a fuel injection valve on a fuel distribution pipe, a fuel injection valve is provided with at least two snap springs, and these snap springs extend in parallel to the axis of the fuel injection valve. In order to engage the fuel injection valve with an engaging flange provided on the connecting pipe member on the fuel distribution pipe side from backside, an engaging protrusion protruding in the transverse direction is supported on the surfaces facing each other (for example, see the Japanese Patent Publication (unexamined) No. 1991-31572 (pages 7 and 8)).

Since the conventional fuel injection device used in an internal combustion engine is constructed as described above, the fuel injection device disclosed in the Japanese Patent Publication (unexamined) No. 1981-12051 has such problems that a large number of parts are necessary and man-hour and cost of installation are increased. This is because it is necessary to use another engaging member for engaging the fuel injection valve and the connecting pipe member together.

Since the fuel injection device disclosed in the Japanese Patent Publication (unexamined) No. 1991-31572 has a structure in which the snap springs extend in parallel to the axis of the fuel injection valves and are engaged with the engaging flanges provided on the connecting pipe members so as to be fitted between the engaging flanges from backside, a problem exists in that the engaged portions are easily disengaged when any force is applied in the direction of opening the snap springs.

Moreover, since the two snap springs extend in the axial direction, and a connector for electrical connection is arranged at the center in the circumferential direction thereof, several problems exist in that it is necessary to use any mold of a complicated configuration for injection molding and manufacturing cost is increased.

SUMMARY OF THE INVENTION

The present invention has been made to solve the above-discussed problems and has an object of providing a fuel injection device capable of being manufactured at a reasonable cost with a small number of parts.

A fuel injection device of the invention includes a fuel distribution pipe and a fuel injection valve mounted on this fuel distribution pipe. In this fuel injection device, a band-shaped protrusion extends in the radial direction from a flange portion of a connecting pipe member arranged on the fuel distribution pipe and further extends in parallel to the axis of the fuel injection valve. This band-shaped protrusion is provided with a fitting hole, and the fuel injection valve is provided with a protrusion that fits into the fitting hole.

As a result, it is not necessary to use any fixing member for engaging the connecting pipe member and the fuel injection valve together, and it is possible to reduce number of parts and reduce cost of equipment.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiment 1

An embodiment of the invention is hereinafter described with reference to the accompanying drawings.

Figure 1:
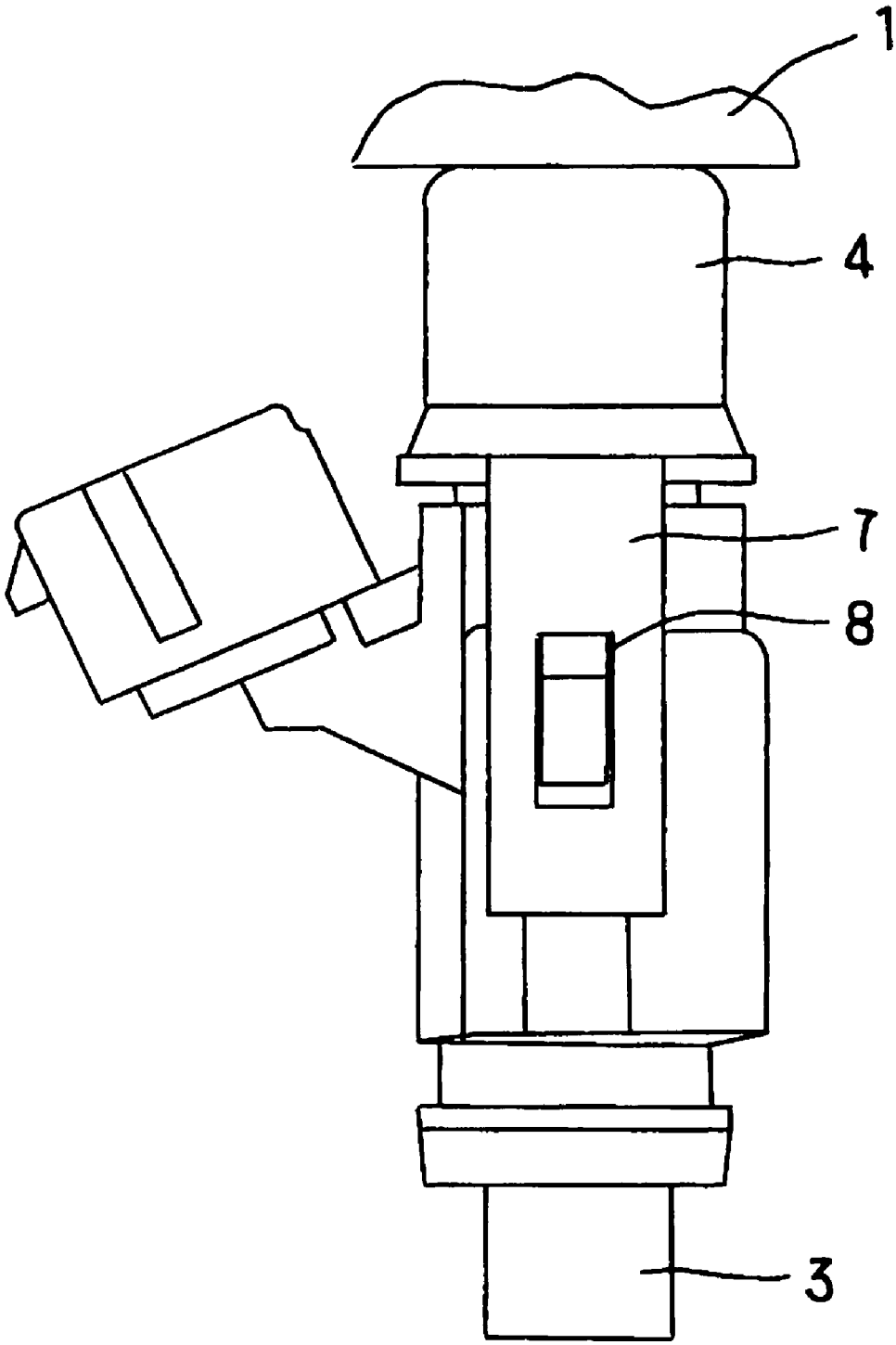
FIG. 1 is a front view showing a fuel injection device according to Embodiment 1 of the invention.
Figure 2:
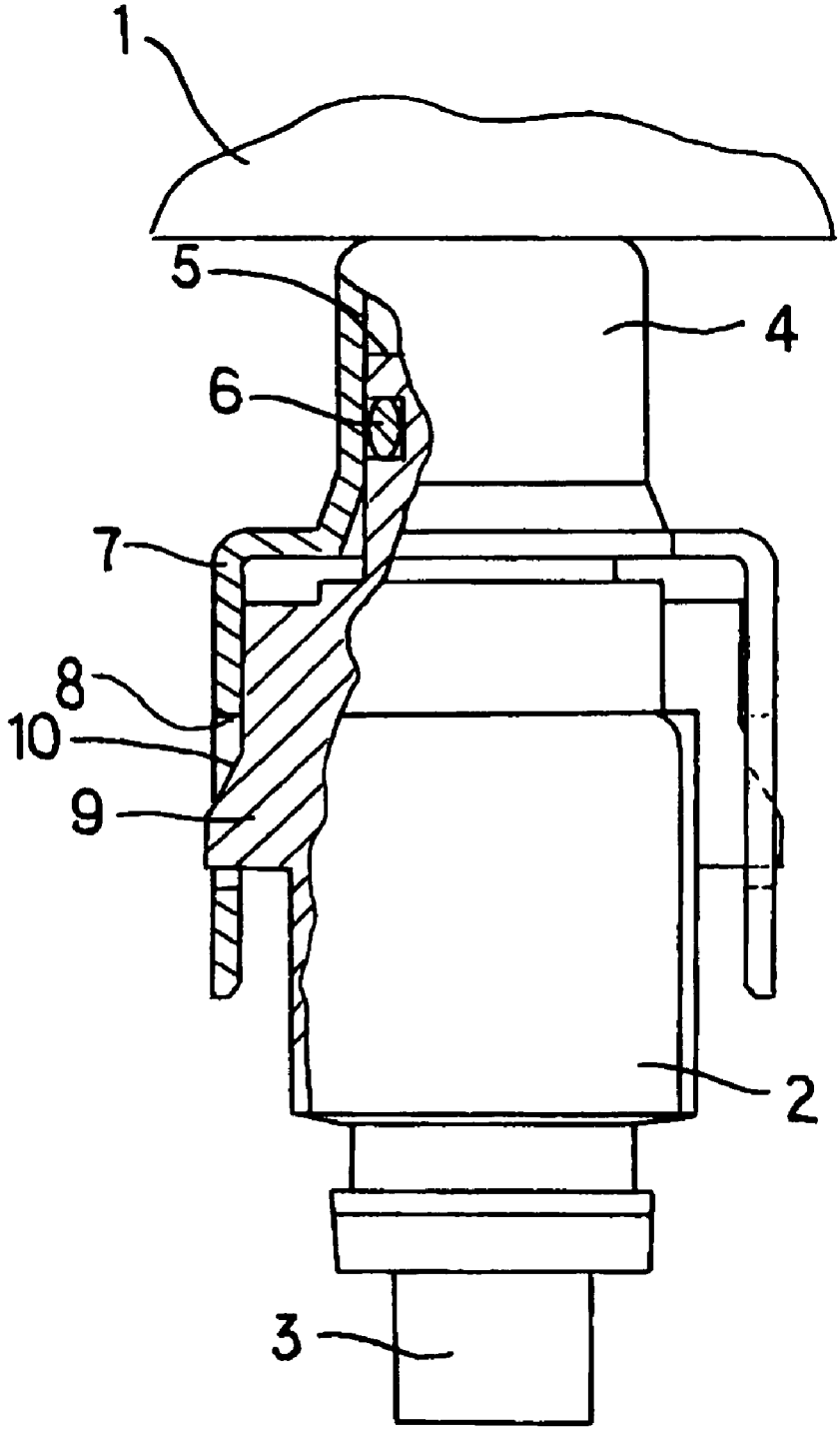
FIG. 2 is a partially sectional side view showing the fuel injection device according to Embodiment 1 of the invention.
Figure 3:
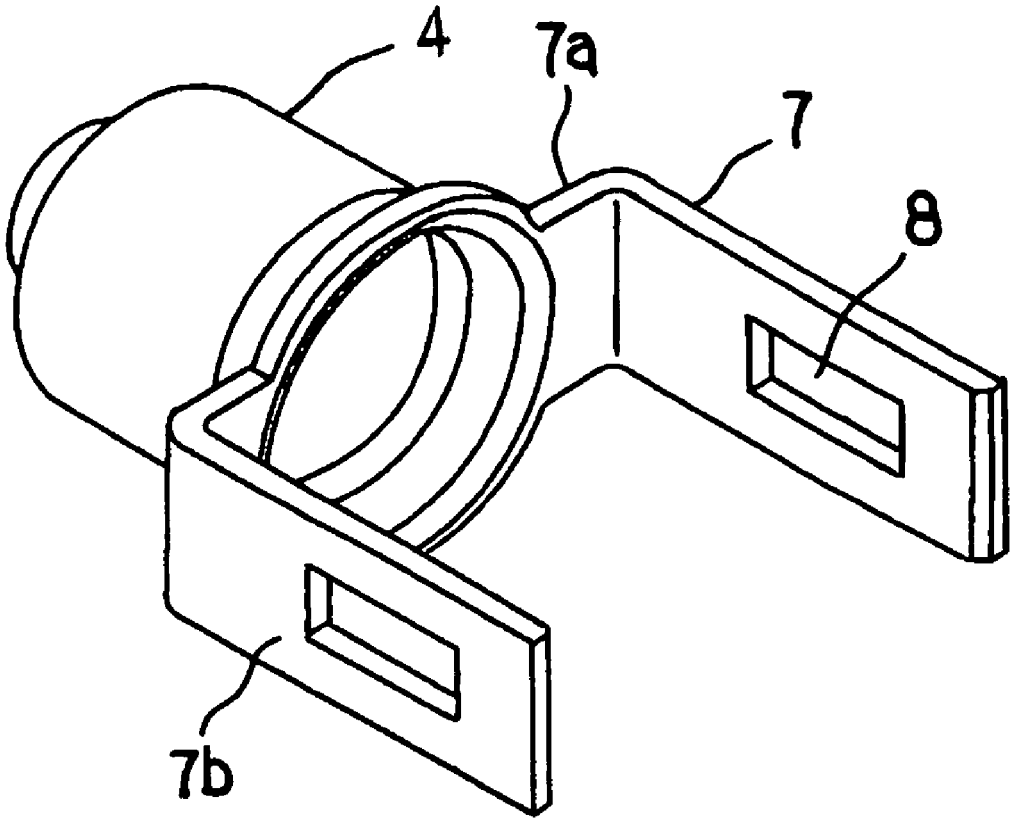
FIG. 3 is a bird's-eye view showing a connecting pipe member.

FIG. 1 is a front view showing a fuel injection device according to Embodiment 1 of the invention, FIG. 2 is a partially sectional side view of the fuel injection device, and FIG. 3 is a bird's-eye view showing a connecting pipe member.

In the drawings, a fuel supply system in this embodiment includes a fuel distribution pipe 1 and a fuel injection valve 2.

The fuel injection valve 2 is mounted on an intake pipe of an internal combustion engine not shown and injects fuel to an intake passage. A solenoid apparatus accommodated in the fuel injection valve causes a needle valve to act, in association with an armature, for opening and closing a fuel injection hole provided in a valve seat so that fuel is injected from a fuel-injecting portion 3.

The fuel distribution pipe 1 includes connecting pipe members 4 which distribute fuel to each cylinders of the internal combustion engine.

A fuel inflow port 5 of the fuel injection valve 2 is inserted in the connecting pipe member 4. An O-ring 6 is disposed between the connecting pipe member 4 and the fuel inflow port 5 and acts as a seal member.

In order to hold the fuel injection valve 2, each connecting pipe member 4 is provided with a band-shaped protrusion 7 consisting of a protruding portion 7*a* that is provided on a free end part of the connecting pipe member and protrudes in the radial direction and an extending portion 7*b* that extends therefrom in the vertical direction, i.e., in the axial direction of the fuel injection valve 2. This band-shaped protrusion 7 is provided with a fitting hole 8.

Further, each fuel injection valve 2 is provided with a protrusion 9 fitted in the fitting hole 8.

When the fuel inflow port 5 of the fuel injection vale 2 is inserted in the connecting pipe member 4, an introduction slope 10 of the protrusion 9 of the fuel injection valve 2 moves while pushing the band-shaped protrusion 7 of the connecting pipe member 4 to extend.

When the protrusion 9 is fitted into the fitting hole 8, the band-shaped protrusion 7 returns to its original state, whereby the protrusion 9 and the fitting hole 8 come to be engaged. As a result, the fuel injection valve 2 is exactly fixed to the connecting pipe member 4 in the axial direction, whereby the fuel distribution pipe 1 and the fuel injection valve 2 come to be coupled.

As described above, in this embodiment, it is not necessary to use any fixing member for engaging the connecting pipe member 4 and the fuel injection valve 2 together, and it is possible to reduce number of parts and the manufacturing cost.

Embodiment 2

Figure 4:
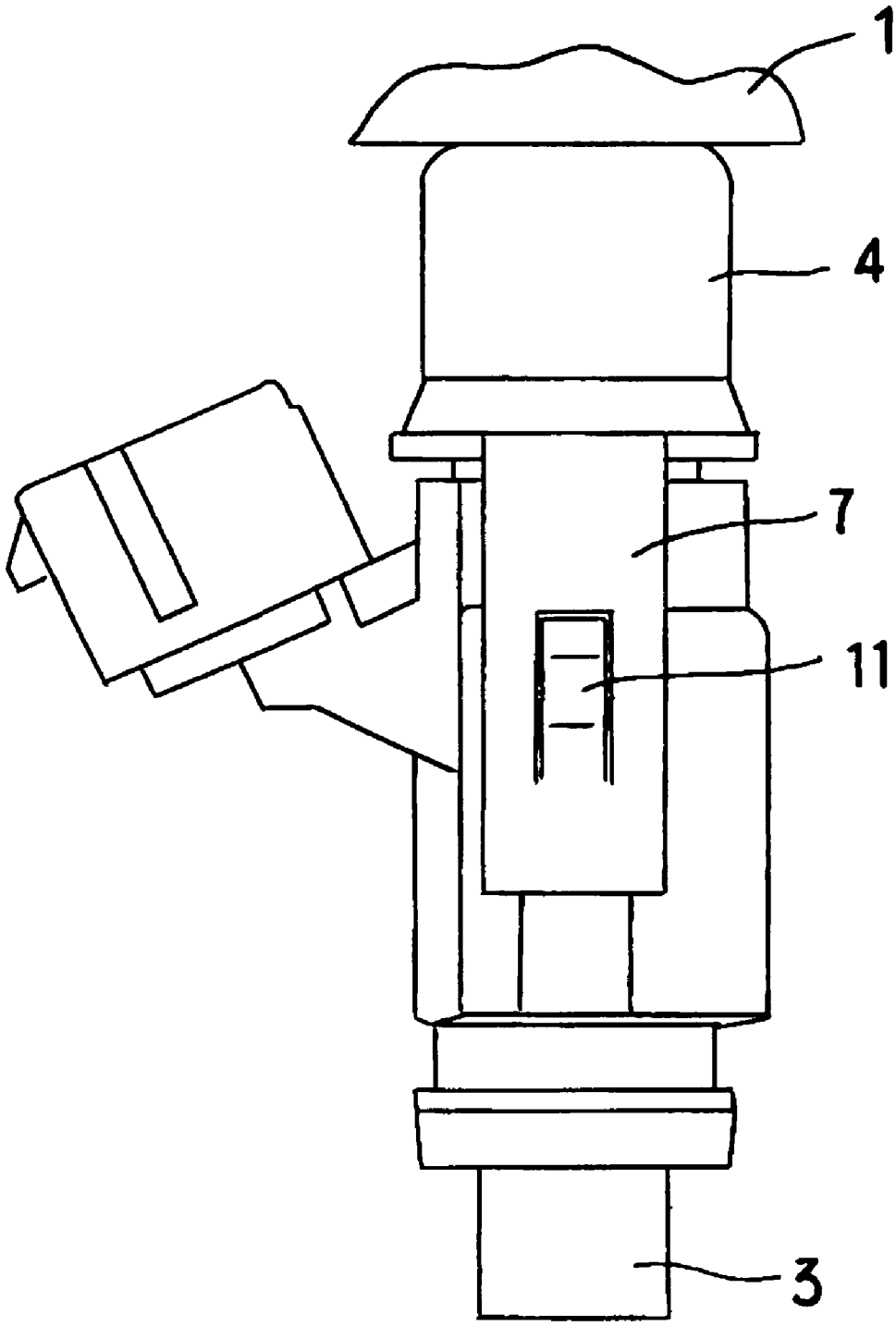
FIG. 4 is a front view showing a fuel injection device according to Embodiment 2 of the invention.
Figure 5:
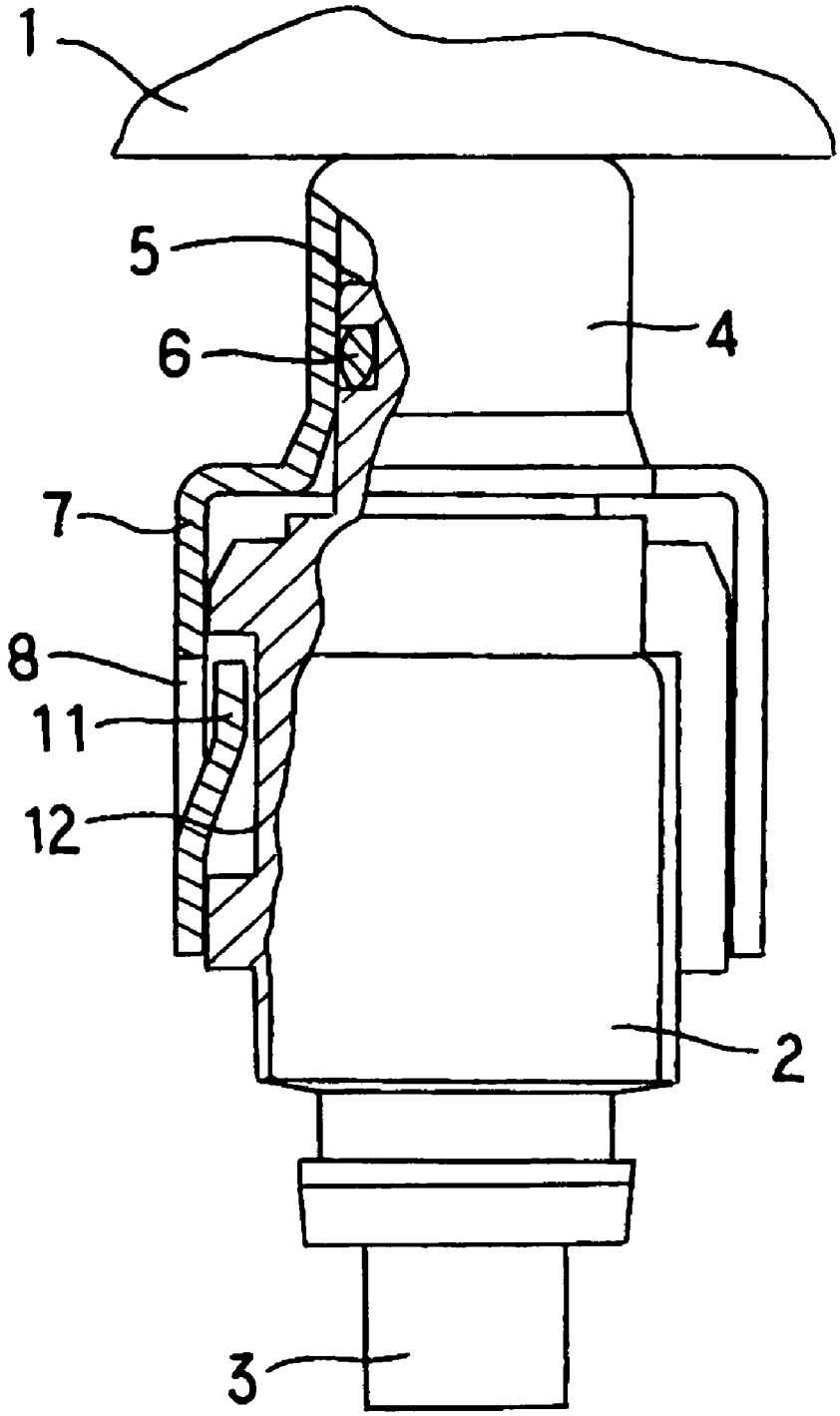
FIG. 5 is a partially sectional side view showing the fuel injection device according to Embodiment 2 of the invention.
Figure 6:
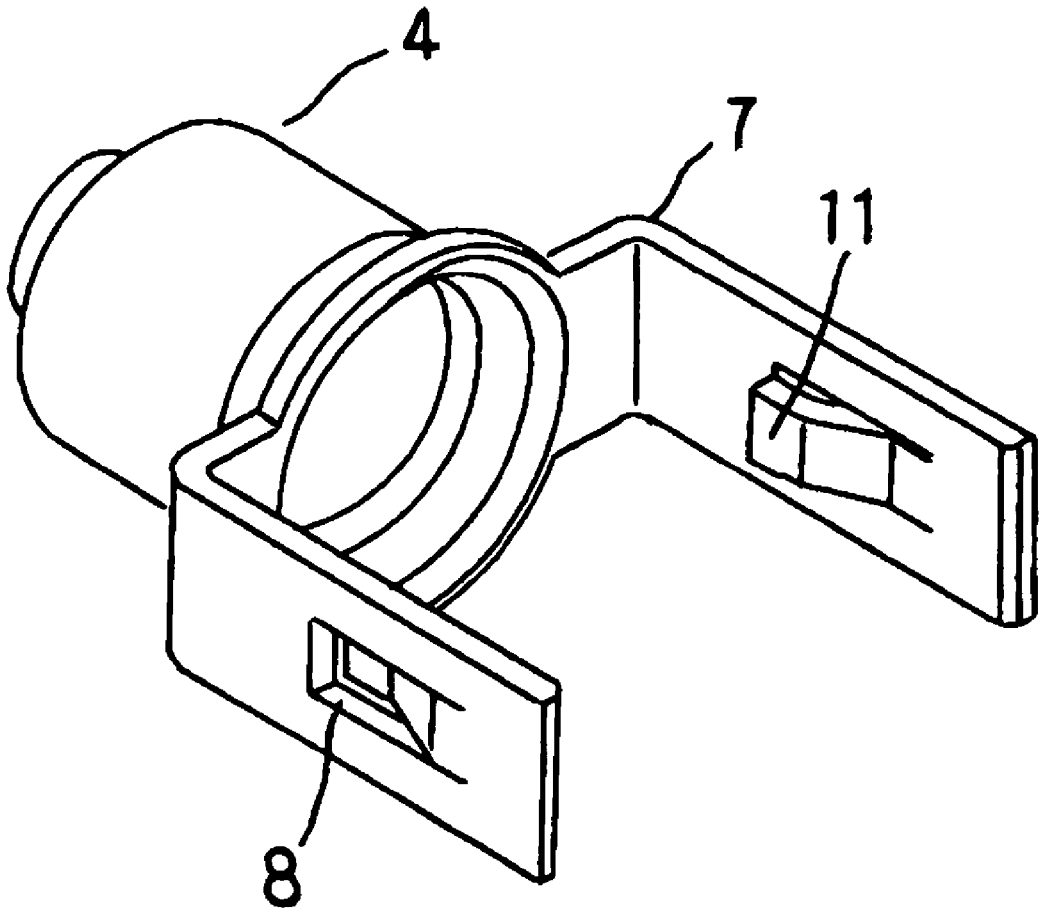
FIG. 6 is a bird's-eye view showing a connecting pipe member.

FIG. 4 is a front view showing a fuel injection device according to Embodiment 2 of the invention, FIG. 5 is a partially sectional side view of this fuel injection device, and FIG. 6 is a bird's-eye view showing a connecting pipe member.

Referring to the drawings, in order to hold the fuel injection valve 2, each connecting pipe member 4 is provided with a band-shaped protrusion 7 that protrudes from a free end part of the connecting pipe member 4 in the radial direction and further extends therefrom in the vertical direction, i.e., in the axial direction of the fuel injection valve 2.

This band-shaped protrusion 7 is provided with a fitting hole 8, and further this fitting hole 8 is provided with a protrusion 11 protruding inward.

Each fuel injection valve 2 is provided with a hollow 12 into which the protrusion 11 is fitted.

When the fuel inflow port 5 of the fuel injection vale 2 is inserted in the connecting pipe member 4, the fuel injection valve 2 pushes the protrusion 11 provided on the band-shaped protrusion 7 outward, and moves while pushing the band-shaped protrusion 7 to extend.

When the protrusion 11 is fitted into the hollow 12, the band-shaped protrusion 7 returns to its original state, thus the protrusion 11 and the hollow 12 coming to be engaged with each other. Consequently, the fuel injection valve 2 is exactly fixed to the connecting pipe member 4 in the axial direction, whereby the fuel distribution pipe 1 and the fuel injection valve 2 come to be coupled.

As described above, in this embodiment, it is not necessary to use any fixing member for engaging the connecting pipe member 4 and the fuel injection valve 2 together, and it is possible to reduce number of parts and the manufacturing cost.

Embodiment 3

Figure 7:
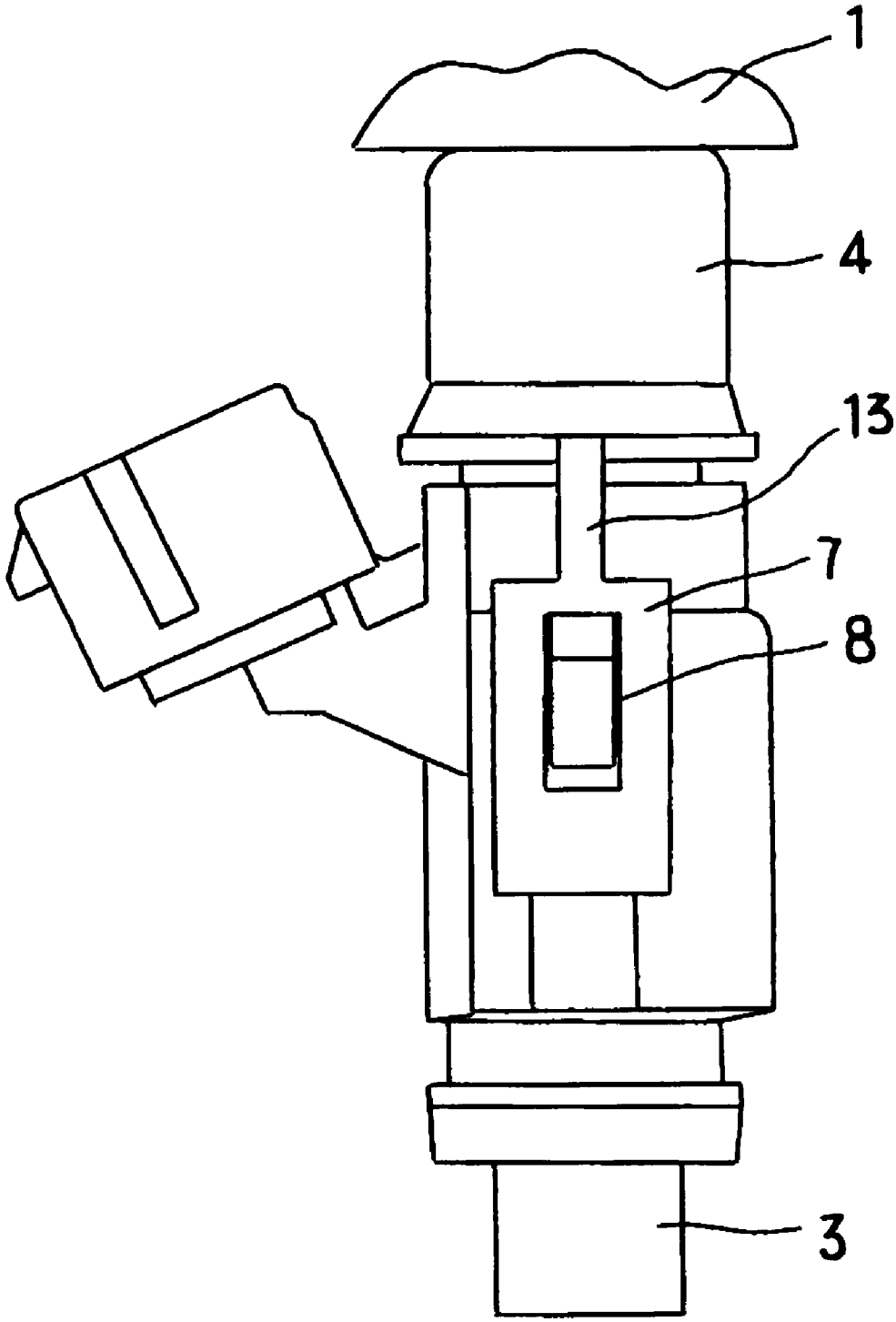
FIG. 7 is a front view showing a fuel injection device according to Embodiment 3 of the invention.
Figure 8:
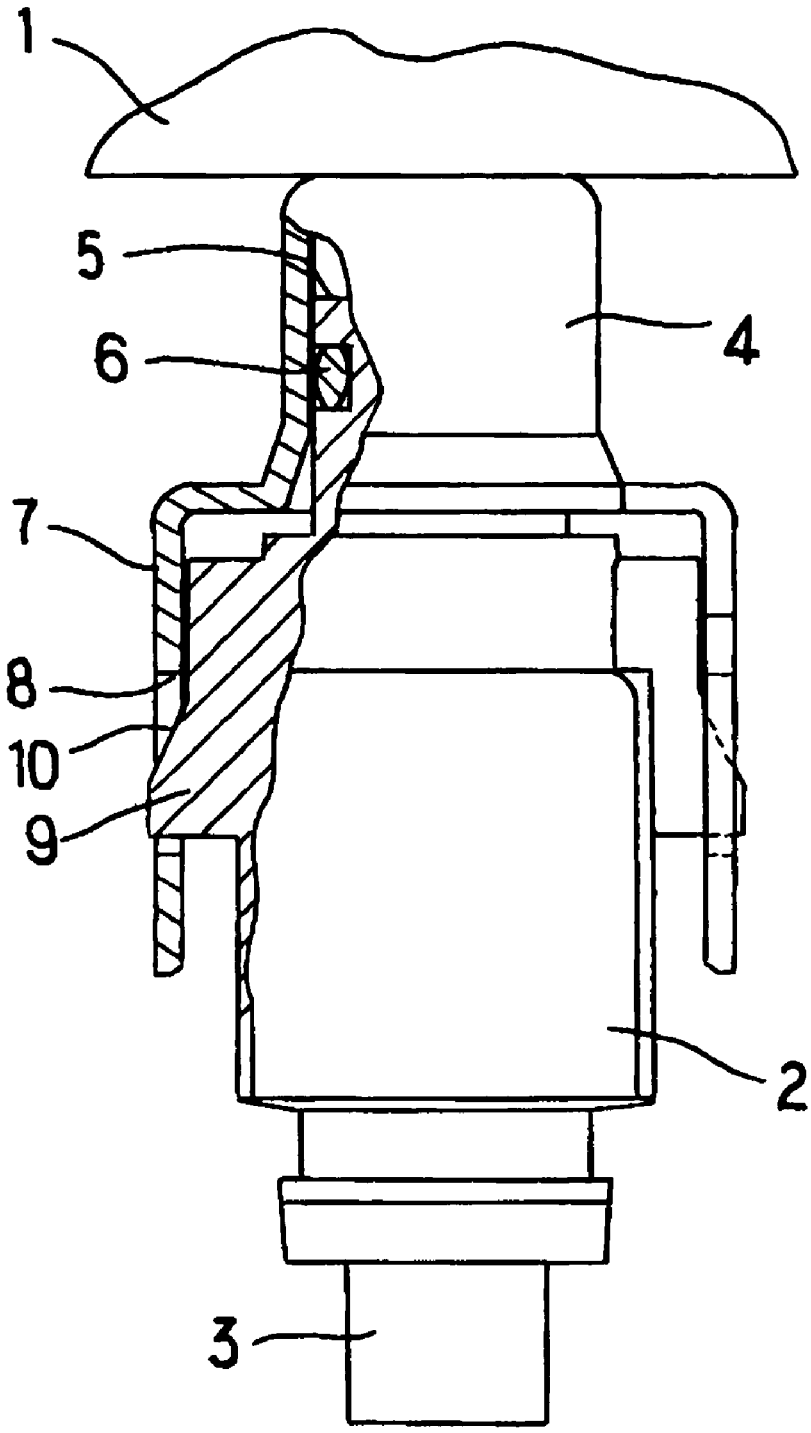
FIG. 8 is a partially sectional side view showing the fuel injection device according to Embodiment 3 of the invention.
Figure 9:
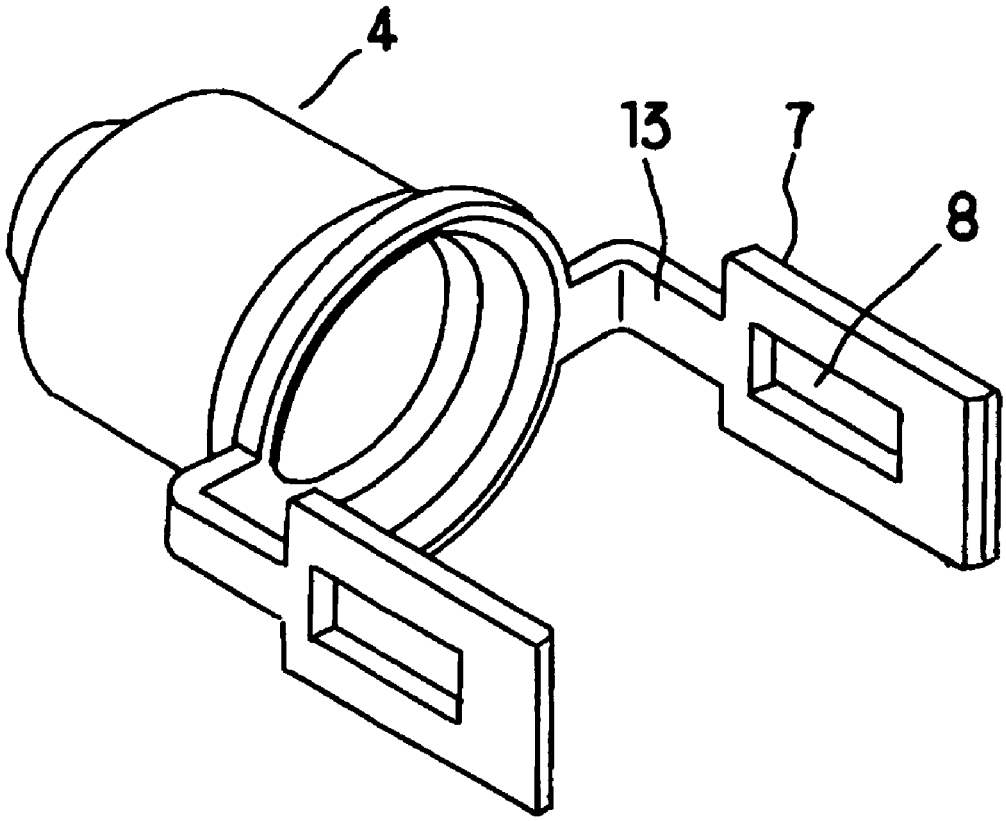
FIG. 9 is a bird's-eye view showing a connecting pipe member.

FIG. 7 is a front view showing a fuel injection device according to Embodiment 3 of the invention, FIG. 8 is a partially sectional side view of this fuel injection device, and FIG. 9 is a bird's-eye view showing a connecting pipe member.

In the drawings, in order to hold the fuel injection valve 2, each connecting pipe member 4 is provided with a band-shaped protrusion 7 that protrudes from a free end part of the connecting pipe member 4 in the radial direction and further extends therefrom in the vertical direction, i.e., in the axial direction of the fuel injection valve 2.

This band-shaped protrusion 7 is provided with a narrow portion 13 whose width is partially reduced. The band-shaped protrusion 7 is also provided with a fitting hole 8.

Each fuel injection valve 2 is provided with a protrusion 9.

When the fuel inflow port 5 of the fuel injection vale 2 is inserted in the connecting pipe member 4, the introduction slope 10 of the protrusion 9 moves while pushing an end part of the band-shaped protrusion 7 of the connecting pipe member 4 to extend.

Since the band-shaped protrusion 7 is provided with the narrow portion 13 whose width is partially reduced, the band-shaped protrusion 7 is elastically deformed without difficulty, and the introduction slope 10 moves while pushing this portion to extend.

When the protrusion 9 is fitted into the fitting hole 8, the band-shaped protrusion 7 returns to its original state, thus the protrusion 9 and the fitting hole 8 come to be engaged. Consequently, the fuel injection valve 2 is exactly fixed to the connecting pipe member 4 in the axial direction, whereby the fuel distribution pipe 1 and the fuel injection valve 2 come to be coupled.

As described above, in this embodiment, since the band-shaped protrusion 7 is partially provided with the narrow portion 13, it is possible to cause the band-shaped protrusion 7 to flex with a small force, and it is possible to mount the fuel injection valve 2 on the connecting pipe member 4 with a small force, thereby considerably facilitating the mounting work.

Although FIGS. 7 to 9 show a modification of the fuel injection device described in the foregoing Embodiment 1, this Embodiment 3 is also applicable to the band-shaped protrusion 7 described in the foregoing Embodiment 2.

Embodiment 4

Figure 10:
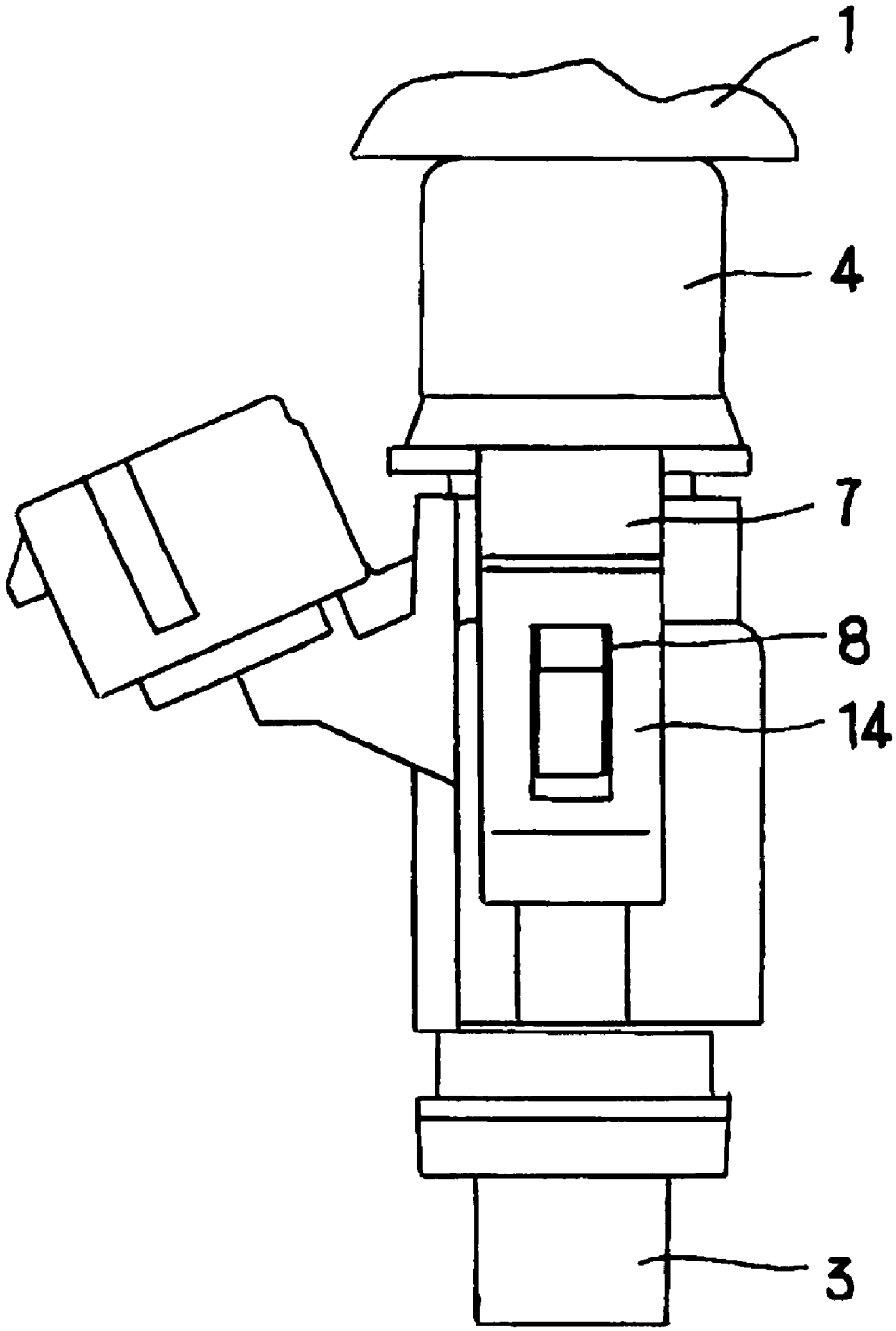
FIG. 10 is a front view showing a fuel injection device according to Embodiment 4 of the invention.
Figure 11:
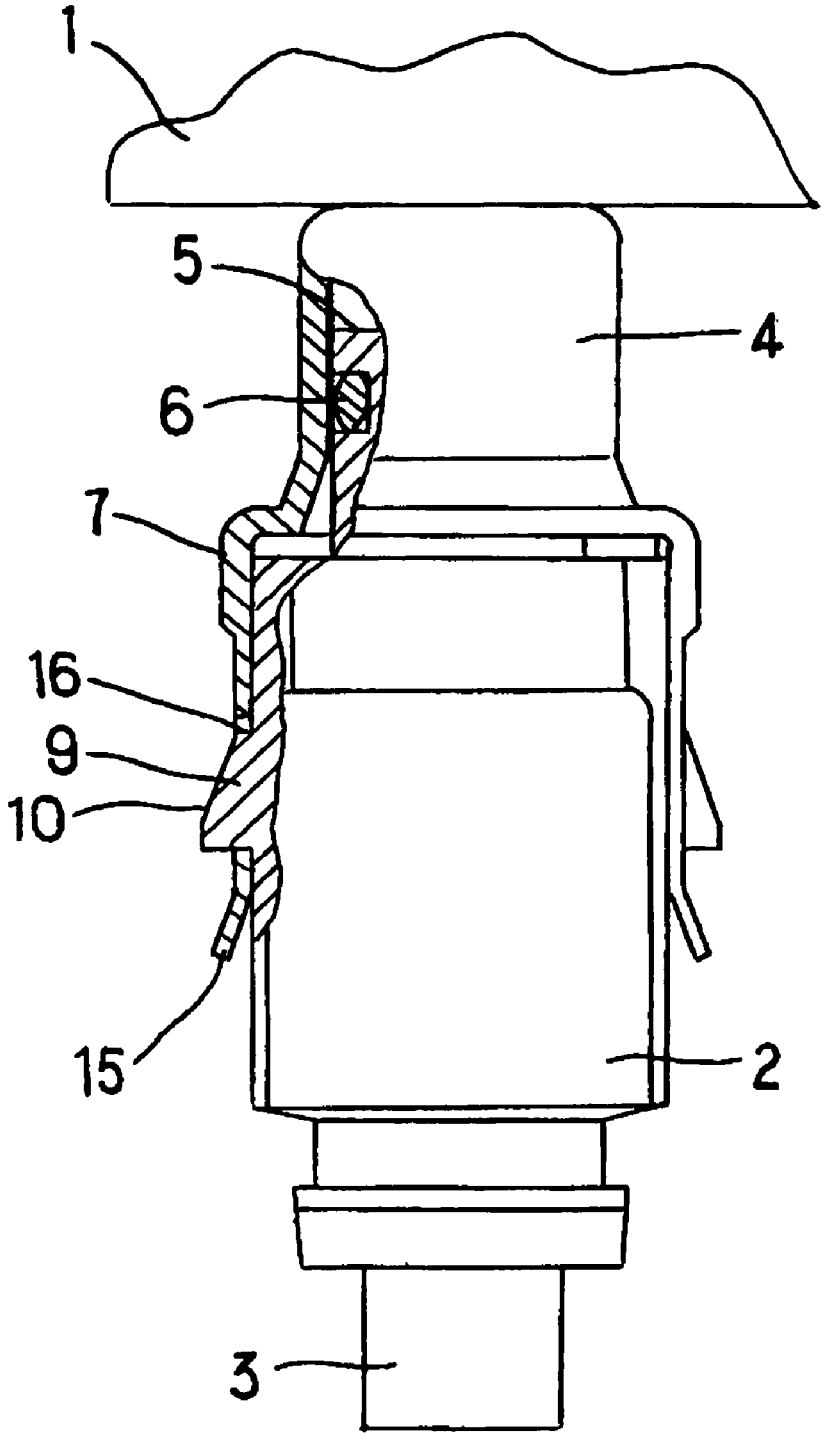
FIG. 11 is a partially sectional side view showing the fuel injection device according to Embodiment 4 of the invention.
Figure 12:
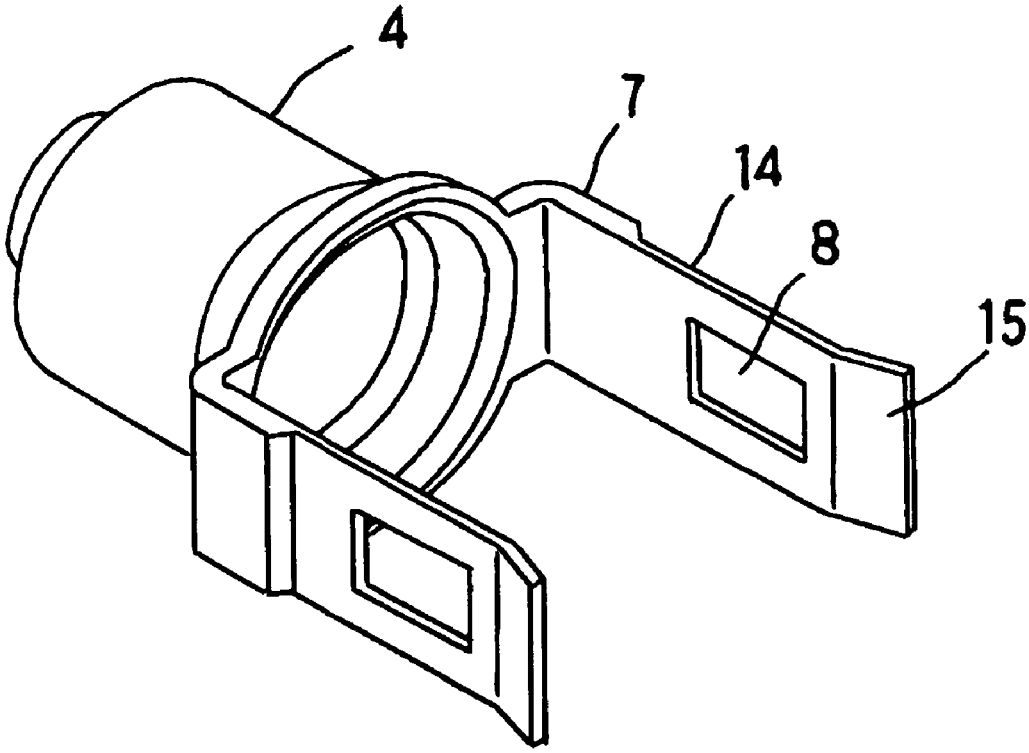
FIG. 12 is a bird's-eye view showing a connecting pipe member.

FIG. 10 is a front view showing a fuel injection device according to Embodiment 4 of the invention, FIG. 11 is a partially sectional side view of this fuel injection device, and FIG. 12 is a bird's-eye view showing a connecting pipe member.

In the drawings, in order to hold the fuel injection valve 2, each connecting pipe member 4 is provided with a band-shaped protrusion 7 that protrudes from a free end part of the connecting pipe member 4 in the radial direction and further extends therefrom in the vertical direction, i.e., in the axial direction of the fuel injection valve 2.

This band-shaped protrusion 7 is provided with a thin-walled portion 14 whose thickness is reduced as compared with the thickness of the main body portion of the connecting pipe member 4. The band-shaped protrusion 7 is also provided with a fitting hole 8 and the band-shaped protrusion 7 is provided with an introduction slope 15 at an end thereof.

Each fuel injection valve 2 is provided with a protrusion 9, and this protrusion 9 is provided with an engaging protrusion 16 at an end thereof.

When the fuel inflow port 5 of the fuel injection vale 2 is inserted into the connecting pipe member 4, the protrusion 9 pushes up the introduction slope 15 provided at the end part of the band-shaped protrusion 7.

Since the band-shaped protrusion 7 is provided with the thin-walled portion 14, the band-shaped protrusion 7 is elastically deformed without difficulty, and the fuel injection valve 2 moves while pushing this portion to extend.

When the protrusion 9 is fitted into the fitting hole 8, the band-shaped protrusion 7 returns to its original state, thus the protrusion 10 and the fitting hole 8 come to be engaged. Consequently, the fuel injection valve 2 is exactly fixed to the connecting pipe member 4 in the axial direction, whereby the fuel distribution pipe 1 and the fuel injection valve 2 come to be coupled.

As described above, in this embodiment, since the band-shaped protrusion 7 is partially provided with the thin-walled portion 14, it is possible to cause the band-shaped protrusion 7 to flex with a small force, and it is possible to mount the fuel injection valve 2 on the connecting pipe member 4 with a small force, thereby considerably facilitating the mounting work.

Although FIGS. 10 to 12 show a modification of the fuel injection device described in the foregoing Embodiment 1, this Embodiment 4 is also applicable to the band-shaped protrusion 7 described in the foregoing Embodiment 2.

Embodiment 5

Figure 13:
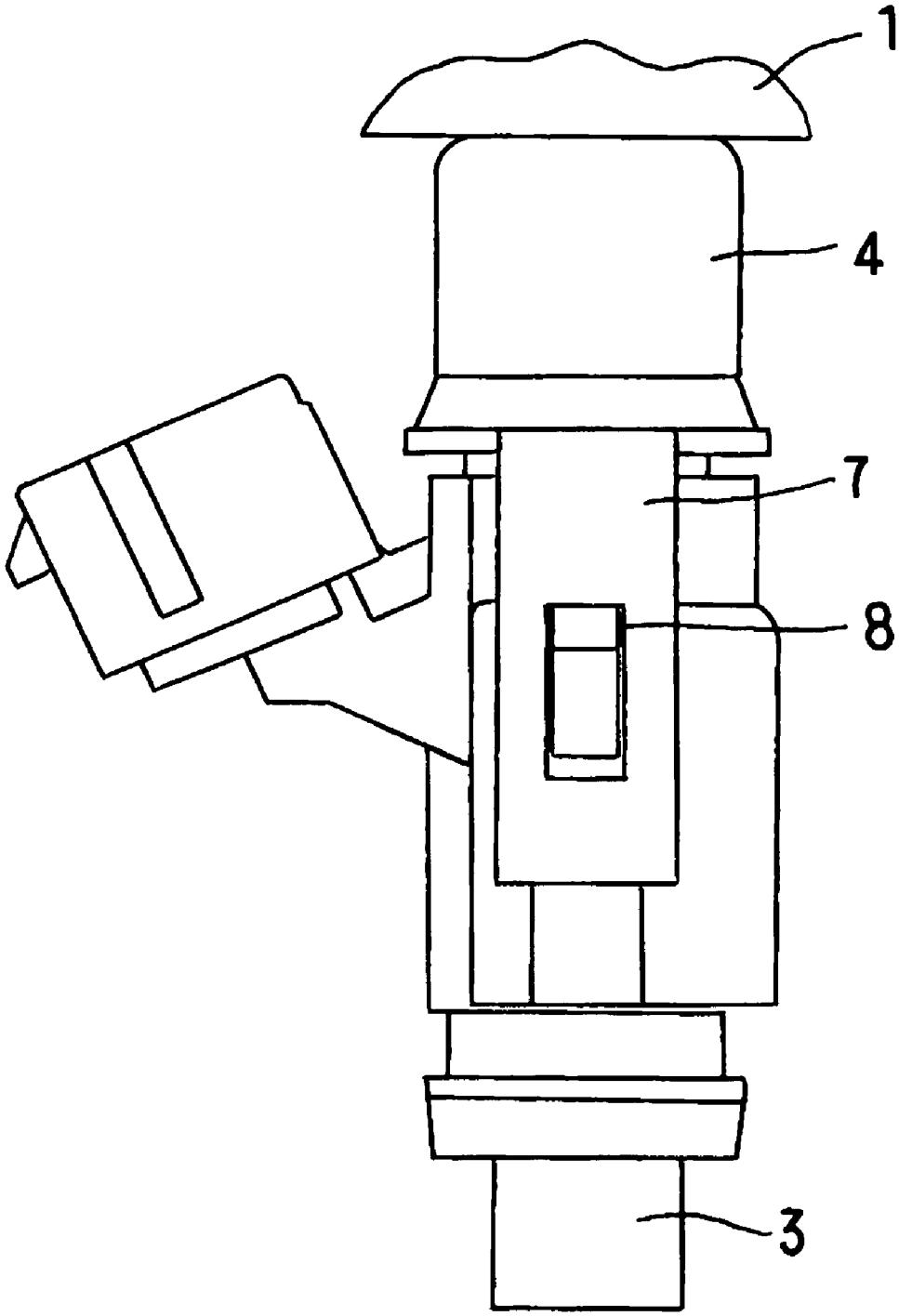
FIG. 13 is a front view showing a fuel injection device according to Embodiment 5 of the invention.
Figure 14:
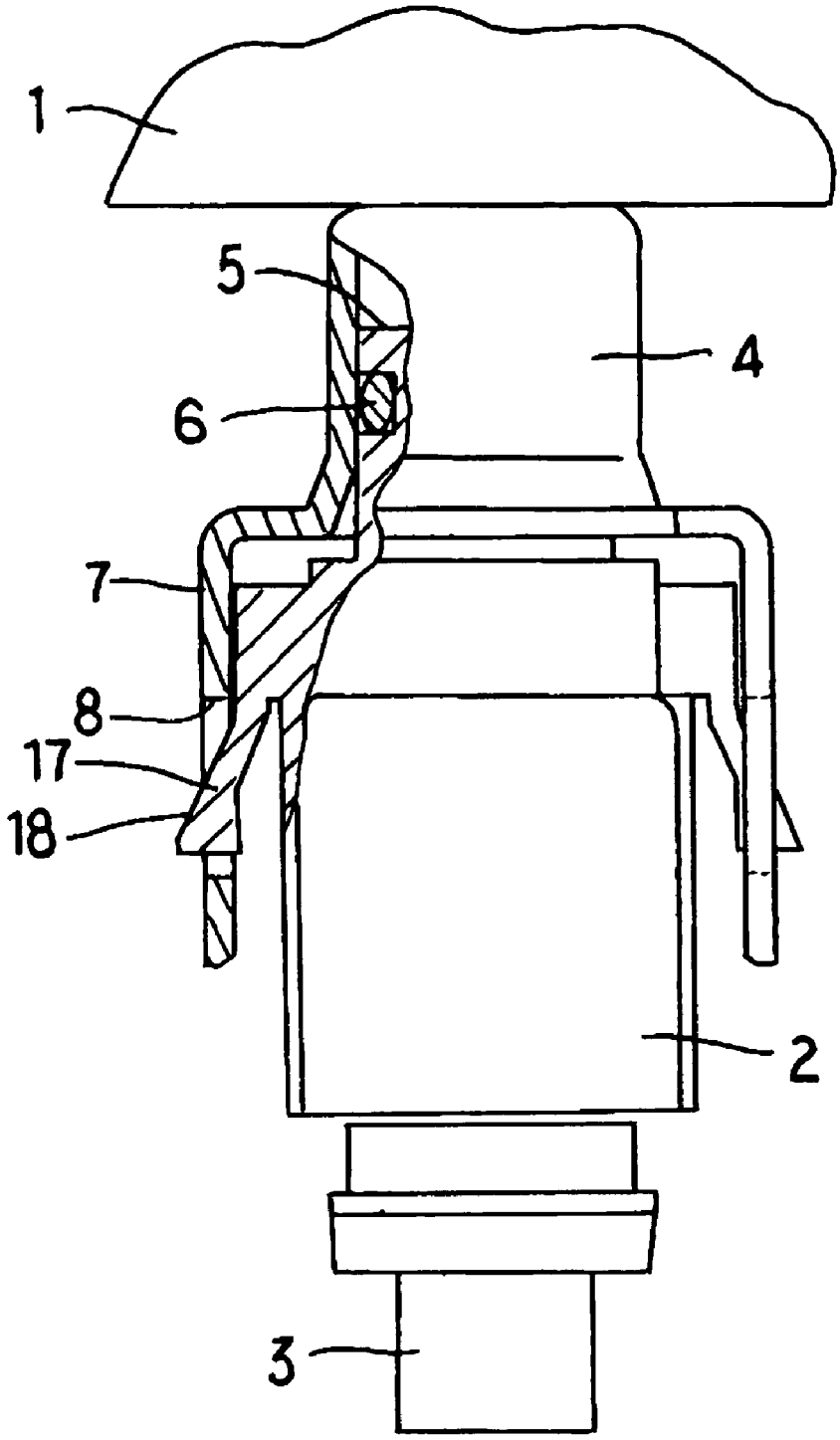
FIG. 14 is a partially sectional side view showing the fuel injection device according to Embodiment 5 of the invention.
Figure 15:
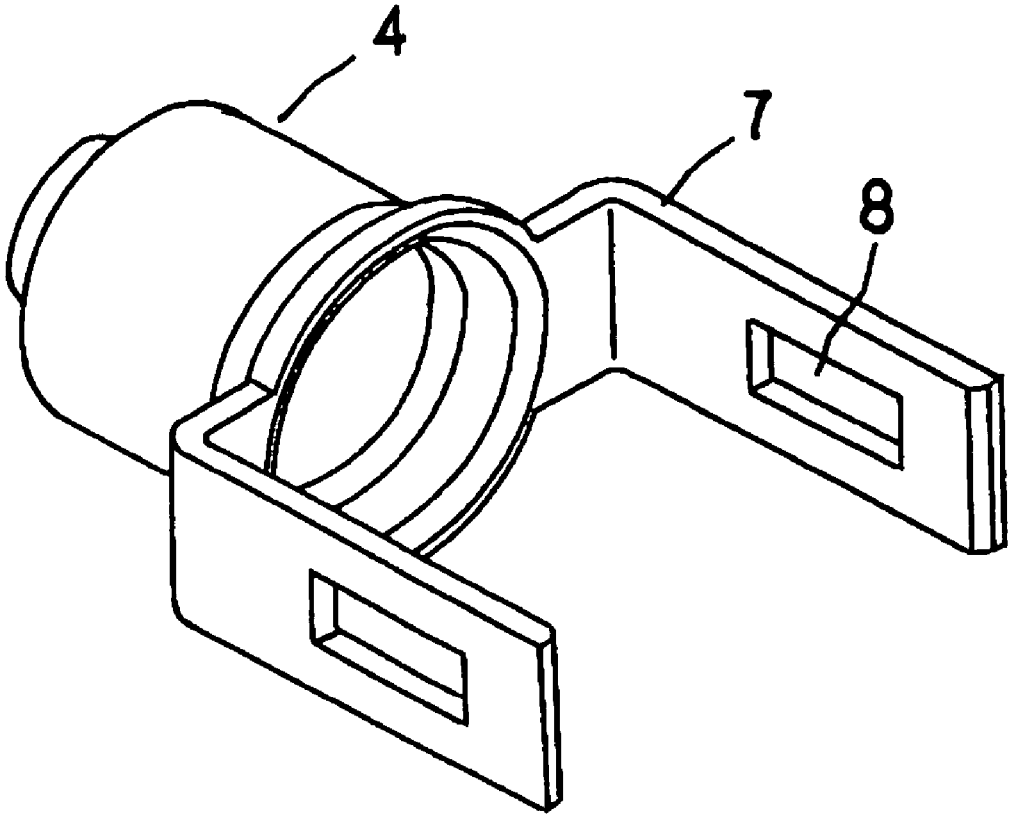
FIG. 15 is a bird's-eye view showing a connecting pipe member.

FIG. 13 is a front view showing a fuel injection device according to Embodiment 5 of the invention, FIG. 14 is a partially sectional side view of this fuel injection device, and FIG. 15 is a bird's-eye view showing a connecting pipe member.

In the drawings, in order to hold the fuel injection valve 2, each connecting pipe member 4 is provided with a band-shaped protrusion 7 that protrudes from a free end part of the connecting pipe member 4 in the radial direction and further extends therefrom in the vertical direction, i.e., in the axial direction of the fuel injection valve 2. This band-shaped protrusion 7 is provided with a fitting hole 8.

Further, each fuel injection valve 2 is provided with a snap spring 17 extending in the axial direction of the fuel injection valve 2.

When the fuel inflow port 5 of the fuel injection vale 2 is inserted into the connecting pipe member 4, an end of the band-shaped protrusion 7 pushes an introduction slope 18 of the snap spring 17, whereby the fuel injection valve 2 moves while pushing the snap spring to contract.

When the snap spring 17 is fitted into the fitting hole 8, the snap spring 17 returns to its original state, thus the snap spring 17 and the fitting hole 8 come to be engaged. Consequently, the fuel injection valve 2 is exactly fixed to the connecting pipe member 4 in the axial direction, whereby the fuel distribution pipe 1 and the fuel injection valve 2 come to be coupled.

As described above, in this embodiment, since the fuel injection valve 2 is provided with the snap spring 17 in place of a protrusion, it is possible to cause the snap spring 17 to flex with a small force, and it is possible to mount the fuel injection valve 2 on the connecting pipe member 4 with a small force, thereby considerably facilitating the mounting work.

It is also preferable in this embodiment that the band-shaped protrusion 7 is formed into the configuration shown in FIG. 9 or 12.

Embodiment 6

Figure 16:
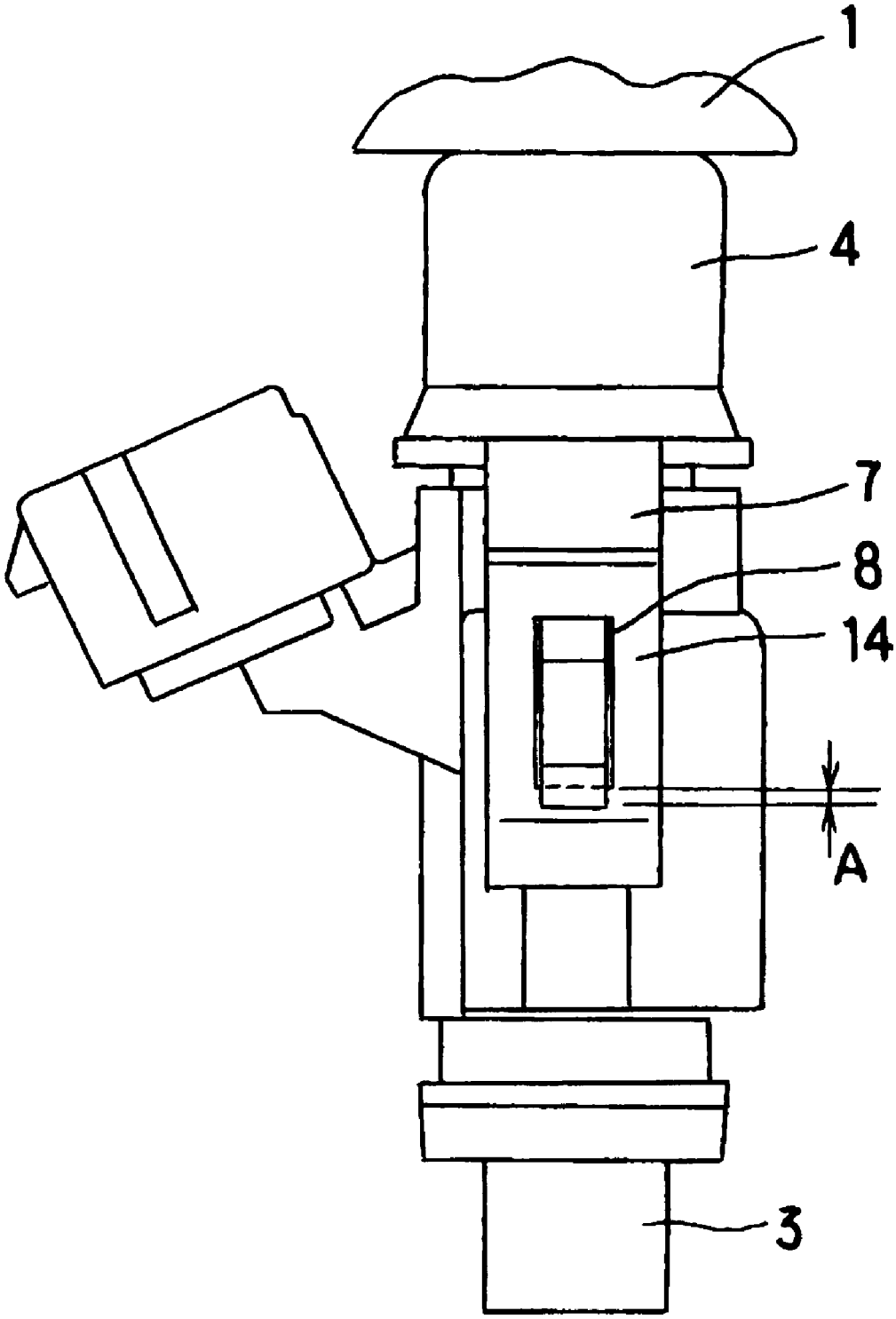
FIG. 16 is a front view showing a fuel injection device according to Embodiment 6 of the invention.
Figure 17:
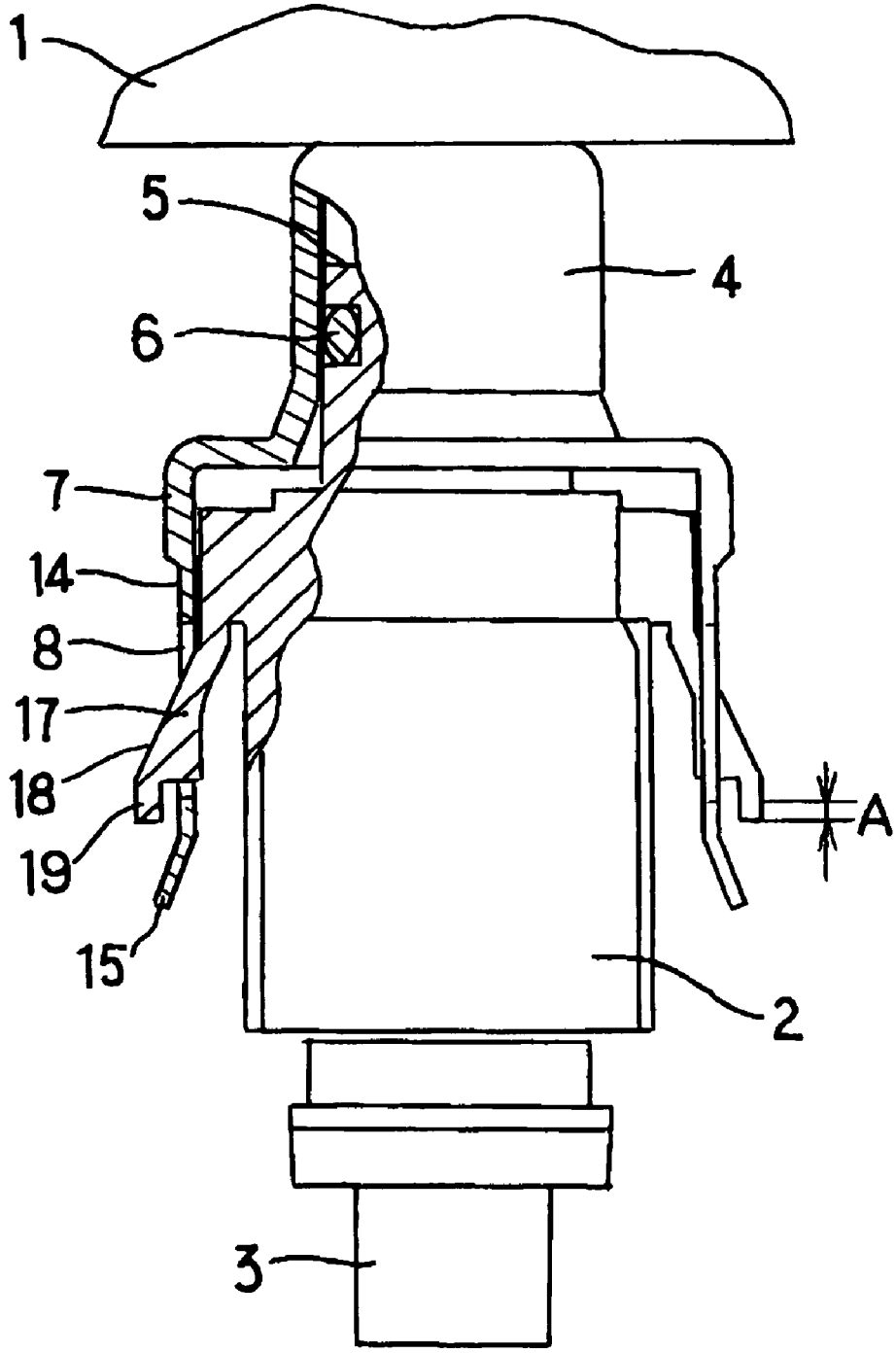
FIG. 17 is a partially sectional side view showing the fuel injection device according to Embodiment 6 of the invention.
Figure 18:
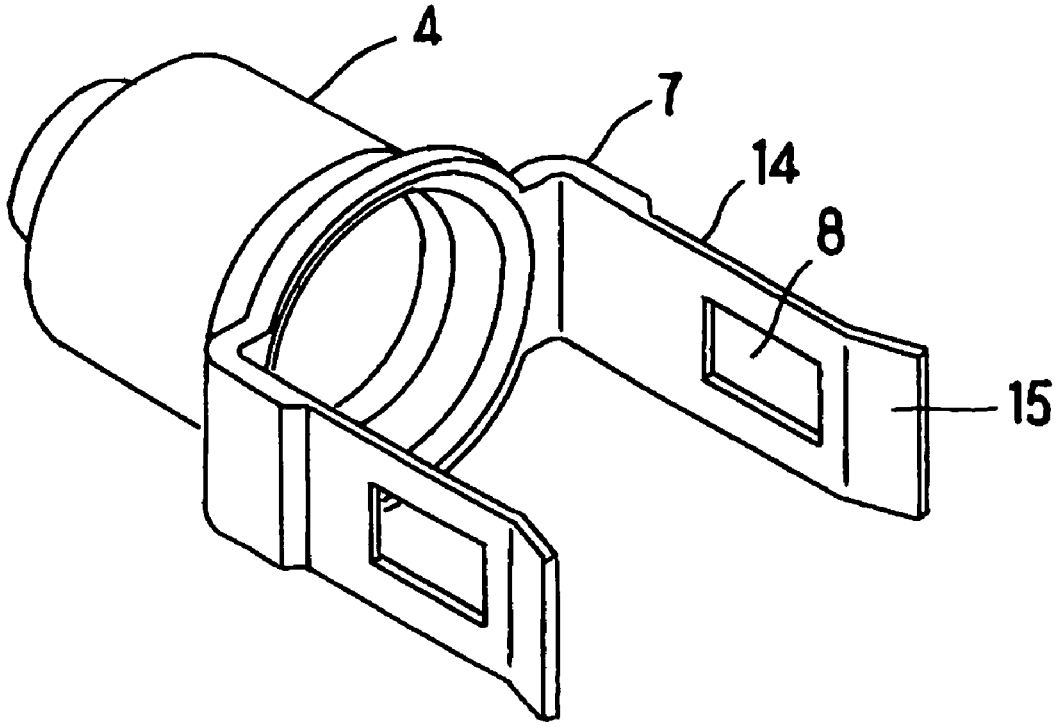
FIG. 18 is a bird's-eye view showing a connecting pipe member.

FIG. 16 is a front view showing a fuel injection device according to Embodiment 6 of the invention, FIG. 17 is a partially sectional side view of this fuel injection device, and FIG. 18 is a bird's-eye view showing a connecting pipe member.

In the drawings, in order to hold the fuel injection valve 2, each connecting pipe member 4 is provided with a band-shaped protrusion 7 that protrudes from a free end part of the connecting pipe member in the radial direction and further extends therefrom in the vertical direction, i.e., in the axial direction of the fuel injection valve 2.

This band-shaped protrusion 7 is provided with a thin-walled portion 14 whose thickness is reduced as compared with the thickness of the main body portion of the connecting pipe member 4. The band-shaped protrusion 7 is also provided with a fitting hole 8 and the band-shaped protrusion 7 is provided with an introduction slope 15 at an end thereof. It is also preferable that the band-shaped protrusion 7 is formed into the configuration shown in FIG. 3 or FIG. 9.

Each fuel injection valve 2 is provided with a snap spring 17 extending in the axial direction of the fuel injection valve 2. This snap spring 17 is provided with an engaging protrusion 19 at an end thereof so that the engaged portion is hardly disengaged even if any transverse force is applied to the fuel injection valve 2.

When the fuel inflow port 5 of the fuel injection vale 2 is inserted into the connecting pipe member 4, the snap spring 17 comes into contact with the introduction slope 15 provided at the end of the band-shaped protrusion 7.

Since the band-shaped protrusion 7 is provided with the thin-walled portion 14, the band-shaped protrusion 7 is elastically deformed without difficulty. The snap spring 17 of the fuel injection valve 2 is also elastically deformed without difficulty. As a result, the fuel injection valve 2 moves while the band-shaped protrusion 7 being pushed to extend and the snap spring 17 being pushed to contract.

Then, when the snap spring 17 is fitted into the fitting hole 8, the band-shaped protrusion 7 and the snap spring 17 return to their original state, thus the snap spring 17 and the fitting hole 8 come to be engaged. Consequently, the fuel injection valve 2 is exactly fixed to the connecting pipe member 4 in the axial direction, whereby the fuel distribution pipe 1 and the fuel injection valve 2 come to be coupled.

When the fuel supply system of this embodiment is installed in an engine, the end of the engaging protrusion 19 provided at the end of the snap spring 17 overlaps the band-shaped protrusion 7 by a dimension A with respect to the fitting hole 8.

As described above, in this embodiment, both the band-shaped protrusion 7 and the snap spring 17 are flexible. This makes it possible to insert the fuel injection valve 2 into the connecting pipe member 4 with less force and considerably facilitates the mounting work.

Moreover, when the fuel injection valve 2 is installed in an engine, the engaging protrusion 19 is positioned with a predetermined overlap A with respect to the fitting hole 8. As a result, the engaged portion is hardly disengaged even if any transverse force is applied to the fuel injection valve 2.

In the case where, for example, a vehicle comes into collision and any excessive force is applied to the fuel distribution pipe 1, the fuel distribution pipe 1 gets out of the place where it has been originally fixed to the engine, and at the same time, any force is applied in the direction of wrenching the fuel injection valve 2 with the portion where the fuel injection valve 2 is inserted in the connecting pipe member 4 acting as a fulcrum.

Since the fuel injection valve 2 is thus wrenched in the direction of opening the snap spring 17, there is a possibility that the fitted snap spring 17 gets out of the fitting hole 8 and the fuel injection valve 2 drops out of the fuel distribution pipe 1.

Even if such an accident occurs, however, since the engaging protrusion 19 is positioned with a predetermined overlap A with respect to the fitting hole, the engaging protrusion hardly comes off from the fitting hole.

While the presently preferred embodiments of the present invention have been shown and described.

It is to be understood that these disclosures are for the purpose of illustration and that various changes and modifications may be made without departing from the scope of the invention as set forth in the appended claims.

What is claimed is:

1. A fuel injection device comprising a fuel distribution pipe and a fuel injection valve mounted on said fuel distribution pipe, wherein a band-shaped protrusion extends in the radial direction from a flange portion of a connecting pipe member arranged on said fuel distribution pipe and further extends in parallel to the axis of said fuel injection valve, said band-shaped protrusion is provided with a fitting hole, and said fuel injection valve is provided with a snap spring that is fitted into said fitting hole and extends in the axial direction of said fuel injection valve.

2. The fuel injection device according to claim 1, wherein said snap spring is provided with an engaging protrusion at an end thereof.

3. The fuel injection device according to claim 1, wherein said band-shaped protrusion is provided with a narrow portion.

4. The fuel injection device according to claim 1, wherein said band-shaped protrusion is provided with a thin-walled portion.

5. The fuel injection device according to claim 1, wherein said snap spring is moveable in a radial direction when mounting the fuel injection valve on said fuel distribution pipe.

* * * * *